US006487800B1

(12) United States Patent
Evans et al.

(10) Patent No.: US 6,487,800 B1
(45) Date of Patent: Dec. 3, 2002

(54) MANUALLY OPERATED COUPLER FOR WORK TOOLS

(75) Inventors: Robert D. Evans, Alma; Gary R. Woerman, Wamego, both of KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/625,941

(22) Filed: Jul. 26, 2000

(51) Int. Cl.[7] ..... E02F 3/36
(52) U.S. Cl. ..... 37/468; 403/322.1; 414/723
(58) Field of Search ..... 37/403, 468; 414/723; 411/412, 413; 403/321, 322.1

(56) References Cited

U.S. PATENT DOCUMENTS

| | | | | |
|---|---|---|---|---|
| 3,512,665 | A | | 5/1970 | Westendorf |
| 4,790,702 | A | * | 12/1988 | Maganias |
| 5,145,313 | A | * | 9/1992 | Weyer |
| 5,727,342 | A | | 3/1998 | Horton |
| 5,816,012 | A | | 10/1998 | Willis |
| 5,865,584 | A | | 2/1999 | Onofrio |
| 5,890,871 | A | | 4/1999 | Woerman |
| 5,950,735 | A | | 9/1999 | Godbersen |
| 5,966,850 | A | | 10/1999 | Horton |
| 5,983,535 | A | * | 11/1999 | Kaczmarski et al. |
| 6,123,501 | A | * | 9/2000 | Pisco |
| 6,233,852 | B1 | * | 5/2001 | Pemberton |
| 6,254,331 | B1 | * | 7/2001 | Pisco et al. |

* cited by examiner

*Primary Examiner*—Christopher J. Novosad
(74) *Attorney, Agent, or Firm*—Hancock & Estabrook, LLP; James R. Smith

(57) ABSTRACT

A quick coupler for manually coupling a tool, such as a bucket, to an earth working machine. The latching mechanism of the quick coupler includes a pair of mounting plates, each having a pair of openings therein, affixed between two laterally spaced plates of the coupler, wherein one of the mounting plates include threaded openings therein. A latch bar which is slidably mounted between the plates. A pair of fasteners extending from the latch bar, wherein the fasteners include a first and second threaded region, separated by a non-threaded region. The threaded regions of the fasteners threadedly engage the threaded openings of the one mounting plate, while the non-threaded region bypasses the opening.

14 Claims, 5 Drawing Sheets

MANUALLY OPERATED COUPLER FOR WORK TOOLS

TECHNICAL FIELD

This invention relates generally to a quick coupler for attaching material handling tools to an earth working machine, and more particularly, to a latching mechanism for the quick coupler.

BACKGROUND ART

In recent years, quick couplers have become commonly used for detachably connecting work tools, for example, buckets, to earth working machines, such as backhoes, excavators and loaders. Such quick couplers are advantageous because they allow a machine operator to change from one work tool to another. Thus, the use of a quick coupler makes the machine much more versatile.

Manually actuated quick couplers typically include a latching mechanism that utilizes a threaded fastener. Since the threaded portion of the fastener typically extends the length of the fastener, the machine operator wastes a great deal of time and energy wrenching the fastener its entire length to engage or disengage the latching mechanism of the quick coupler. The present invention is directed to overcoming one or more of the problems or disadvantages associated with the prior art.

DISCLOSURE OF THE INVENTION

One aspect of the present invention provides an apparatus for coupling a tool to a machine, comprising: a pair of plates, having a base mounted therebetween, pivotally connected to an extension of the machine; an opening within a first end of the pair of plates; and a latching mechanism partially disposed within the opening of the plates for securely fastening the machine to a bracket of the tool, wherein the latching mechanism further includes at least one fastener having a first and a second threaded region, and a non-threaded region between the first and second threaded regions. This aspect provides an earth working machine having a quick coupler adapted to quickly and efficiently engage or disengage a work tool. In particular, a latching mechanism secures the quick coupler to a pair of coupler receiving brackets of the work tool. The latching mechanism comprises of a pair of mounting plates securely fastened between the sides plates of the coupler, and a latch bar having a pair of jackscrew fasteners extending therefrom. The jackscrew fasteners include a first and second threaded region separated by a non-threaded region. The first and second threaded regions of the jackscrew fasteners threadedly engage the mounting plate of the coupler as the jackscrew and the latch bar traverse forward and backward within slots in the plates. The non-threaded region between the first and second threaded regions allow the operator to more quickly bias the jackscrew forward or backward by merely bypassing the small first or second threaded regions of the jackscrew fastener. In other words, the latching mechanism of the coupler may be engaged or disengaged without wrenching the fastener the entire length of the fastener, as is conventional.

The second general aspect of the present invention provides a latching mechanism of a coupling device for coupling a machine to a tool comprising: a mounting device affixed to a first end of a pair of plates of a coupling device; a latch bar slidably mounted within an opening of the pair of plates; and at least one fastener secured within at least one opening of the latch bar, adapted to threadedly engage the mounting device, wherein the fastener includes at least two threaded regions separated by a non-threaded region. This aspect provides a latching mechanism for the coupling device having similar advantages as those associated with the first general aspect.

The third general aspect of the present invention provides a fastener for a coupling device 20 for coupling a machine to a tool comprising: a first threaded region; a second threaded region; and a non-threaded region between the first and second threaded regions. This aspect provides a jackscrew fastener having similar advantages as those associated with the first general aspect.

The fourth general aspect of the present invention provides a machine comprising: a tool coupled to a coupling device of the machine, wherein the coupling device includes a fastener having a first and a second threaded region, separated by a non-threaded region. This aspect provides similar advantages as those associated with the first general aspect.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

BEST MODE FOR CARRYING OUT THE INVENTION

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. Although the drawings are intended to illustrate the present invention, the drawings are not necessarily drawn to scale.

Figure 1:
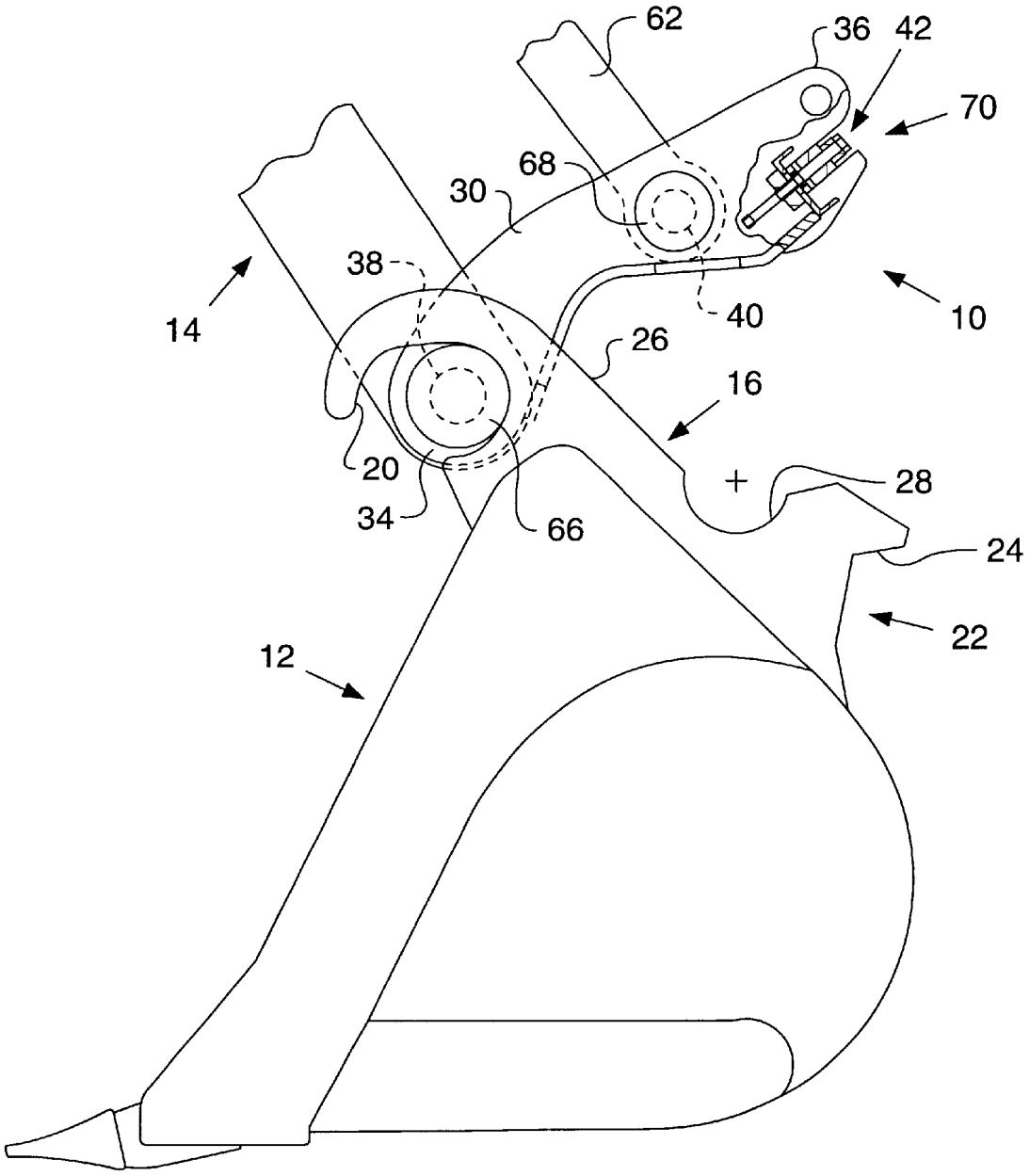
FIG. 1 depicts a fragmentary side elevational view of a bucket in the process of being coupled to a quick coupler, in accordance with a preferred embodiment of the present invention.
Figure 2:
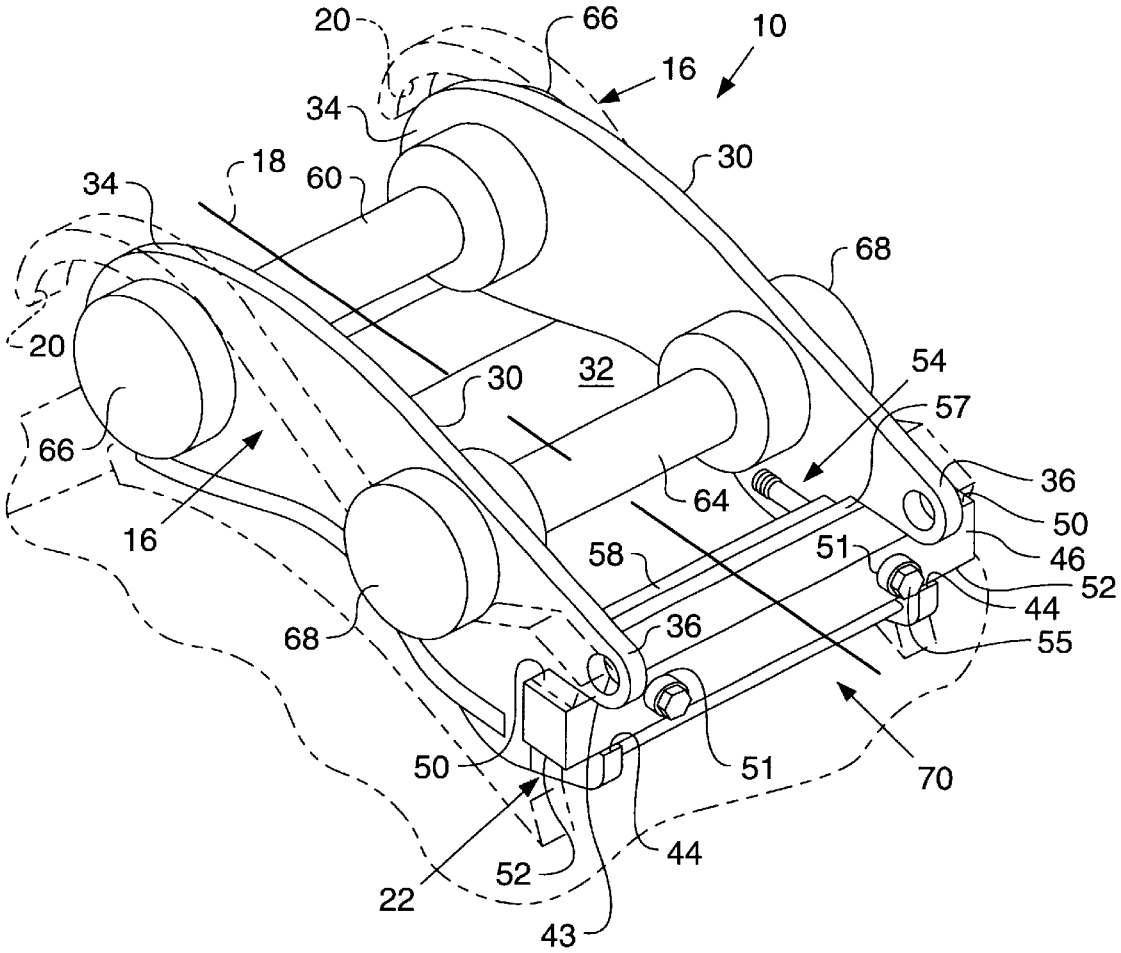
FIG. 2 depicts a perspective view of the quick coupler shown in FIG. 1, in accordance with a preferred embodiment of the present invention.

Referring to the drawings, FIG. 1 shows a quick coupler 10 for detachably connecting a work tool, such as a bucket 12, to the distal end of a support arm or stick 14 of a work machine, such as a hydraulic excavator (not shown). The bucket 12 is provided with a pair of upstanding coupler receiving brackets 16, one of which is shown in FIG. 1. The brackets 16 are spaced a predetermined distance apart on opposite sides of longitudinally extending axis 18, as shown in FIG. 2. Referring again to FIG. 1, each bracket 16 includes an elongated hook opening 20 at one end thereof and a latching notch 22 at the other end thereof. Each of the latching notches 22 has an inclined wedge surface 24 thereon. Each bracket 16 also includes an outer edge 26 having a generally semi-circular cradle opening 28 formed therein. The brackets 16 are preferably affixed to the bucket 12 by welding. In the alternative, the brackets 16 may be removably mounted to the bucket 12, for instance, with bolts, etc.

The quick coupler 10 has a pair of side plates 30, one of which is shown in FIG. 1. The side plates 30 are connected to one another by a bottom plate 32, as depicted in FIG. 2. The side plates 30 are laterally spaced at a predetermined distance apart on either side of the axis 18 so as to fit between the brackets 16. As clearly seen in FIG. 1, each of the side plates 30 has a first end 34 and an opposite second end 36, and is provided with a first aligned pin opening 38 located adjacent the first end 34, and a second aligned pin opening 40 disposed toward the second end 36. The second end 36 of each plate 30 includes a slot 42, which forms upper and lower latch bar abutment surfaces 43 and 44, respectively (FIG. 2).

Referring to FIGS. 1 and 2, the coupler 10 is pivotally connected at a first end 34 to the stick 14 by a first pin 60, which is mounted within the first pin openings 38 of the side plates 30. The coupler 10 is also pivotally connected at a second end to a pair of links 62 by a second pin 64, which is mounted within the second pin openings 40. Those skilled in the art will appreciate that the links 62 are operatively connected through linkage (not shown) to the stick 14 in a well known manner for pivoting the coupler 10 about the first pin 60.

A first pair of trunnions 66 and a second pair of trunnions 68 are attached outboard the side plates 30 of the coupler 10. The first pair of trunnions 66 are preferably disposed in axial alignment with the first pin 60, while the second pair of trunnions 68 are preferably axially aligned with the second pin 64. The first pair of trunnions 66 are adapted for receipt within the respective hook openings 20 of the brackets 16, and the second pair of trunnions 68 are adapted for receipt within the respective cradle openings 28 of the brackets 16, for mounting the coupler 10 to the brackets 16.

Figure 3:
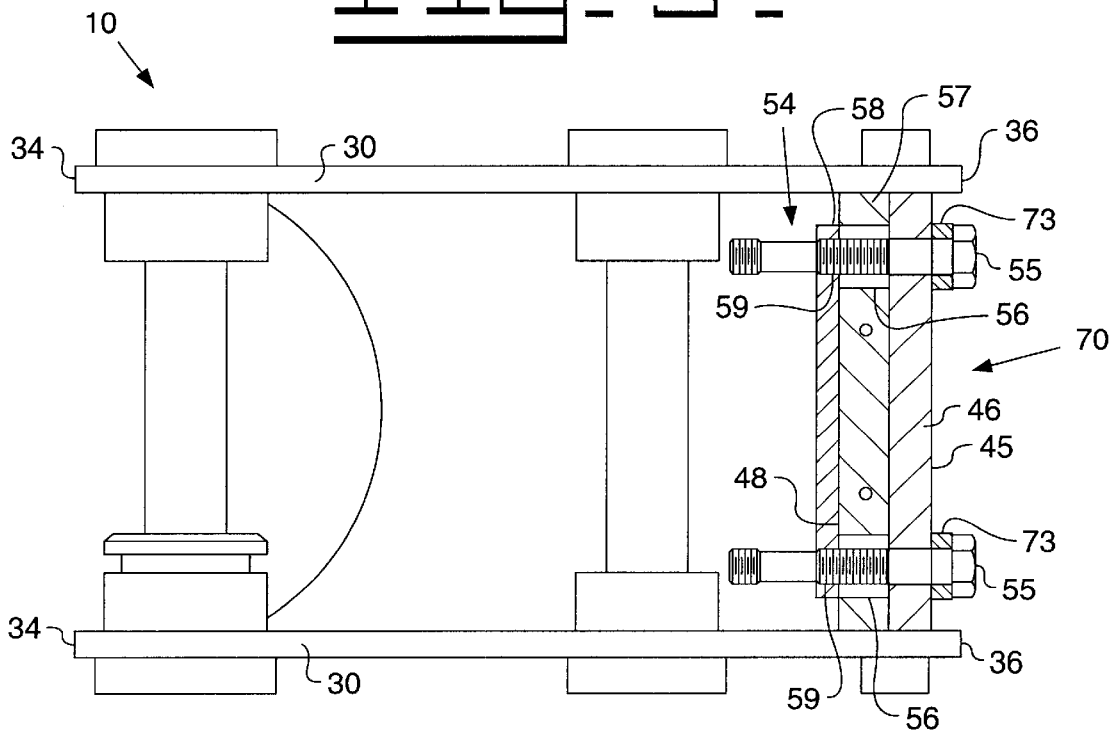
FIG. 3 depicts a top view of the coupler shown in FIG. 2 with the latching mechanism shown in a latched or closed position, in accordance with a preferred embodiment of the present invention.
Figure 4:
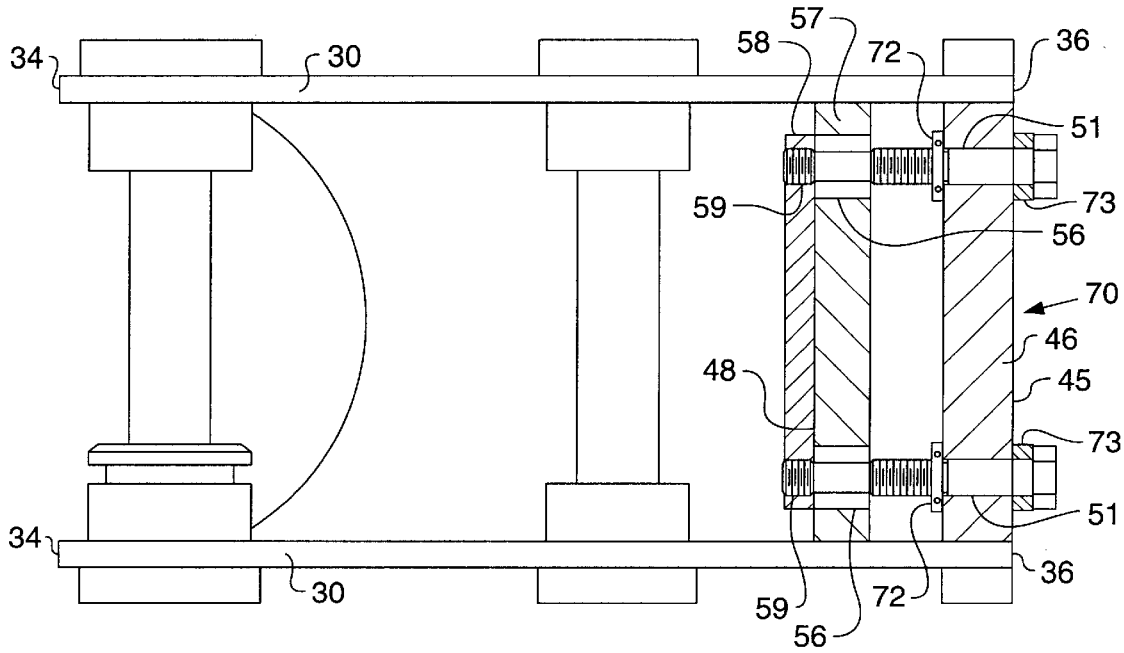
FIG. 4 depicts a top view of the coupler shown in FIG. 2 with the latching mechanism shown in an open position, in accordance with a preferred embodiment of the present invention.

In accordance with the present invention, the coupler 10 is provided with a fastening or latching mechanism 70 for securing the quick coupler 10 to the coupler receiving brackets 16 on the bucket 12. As depicted more clearly in FIGS. 3 and 4, the latching mechanism 70 includes a first mounting plate 57 secured between the side plates 30 toward the second end 36. The first mounting plate 57 includes a pair of openings 56 therein. A second mounting plate 58 is securely attached to a first surface 48 of the first mounting plate 57. The second mounting plate 58 includes a pair of threaded openings 59, which are aligned with the pair of openings 56 within the first mounting plate 57.

The latching mechanism 70 further includes a wedge-shaped transverse latch bar 46, as depicted in FIG. 2. The latch bar 46 reciprocates within the slot 42 at the second end 36 of the side plates 30. The latch bar 46 includes an upper surface 50 which is inclined to match the inclined wedge surface 24 of each of the latching notches 22, as well as the upper abutment surface 43 of each side plate 30. The latch bar 46 further includes a bottom surface 52 adapted to engage the lower abutment surface 44 of each side plate 30. The latch bar 46 also includes a pair of openings 51 (FIGS. 3 and 4), which are aligned with the openings 56, 59 of the first mounting plate 57 and second mounting plate 58, respectively.

Figure 5:
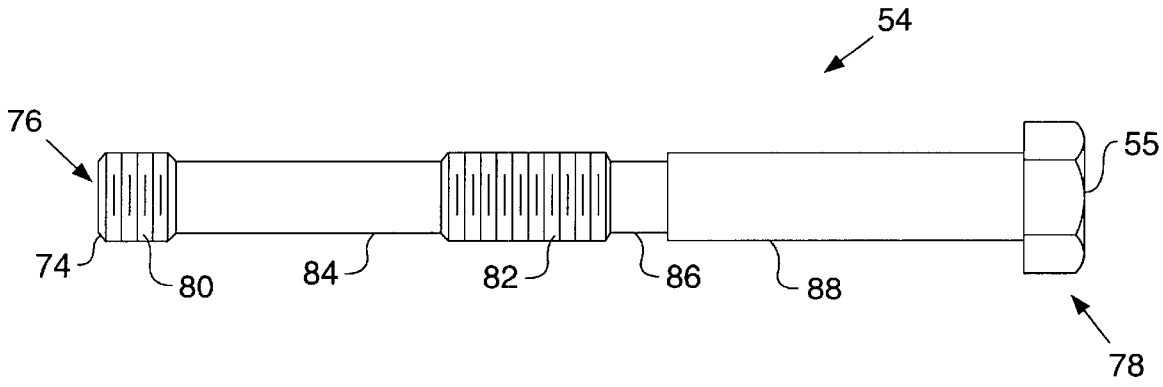
FIG. 5 depicts the fastener used in accordance with a preferred embodiment of the present invention.

An elongated fastening member or jackscrew 54 is mounted within each of the openings 51 of the latch bar 46, and extends from the latch bar 46. FIG. 5 shows the jackscrew 54 in more detail. In particular, the jackscrew 54 includes a pilot portion 74 at a first end 76 of the jackscrew 54, and a head 55 at a second end 78. The pilot portion 74 of the jackscrew 54 further includes a first threaded region 80. The jackscrew 54 further includes a second threaded region 82 axially disposed from the first threaded region 80. A non-threaded region 84 is formed between the first and second threaded regions 80, 82. A necked region 86 is provided between the shaft 88 of the jackscrew 54 and the second threaded region 82.

Referring again to FIGS. 3 and 4, each jackscrew 54 reciprocates within opening 56 of the first mounting plate 57, and threadedly engages the opening 59 of the second mounting plate 58. Several springs or Belville washers 73 are located between the head 55 of the jackscrew 54 and a first side 45 of the latch bar 46, thereby providing a small degree of play or motion such that the operator may easily turn the jackscrew 54. A retaining member 72 is securely fastened around a necked portion of the jackscrew 54, such that the jackscrew 54 maintains its lateral position within the latch bar 46.

Figure 6A:
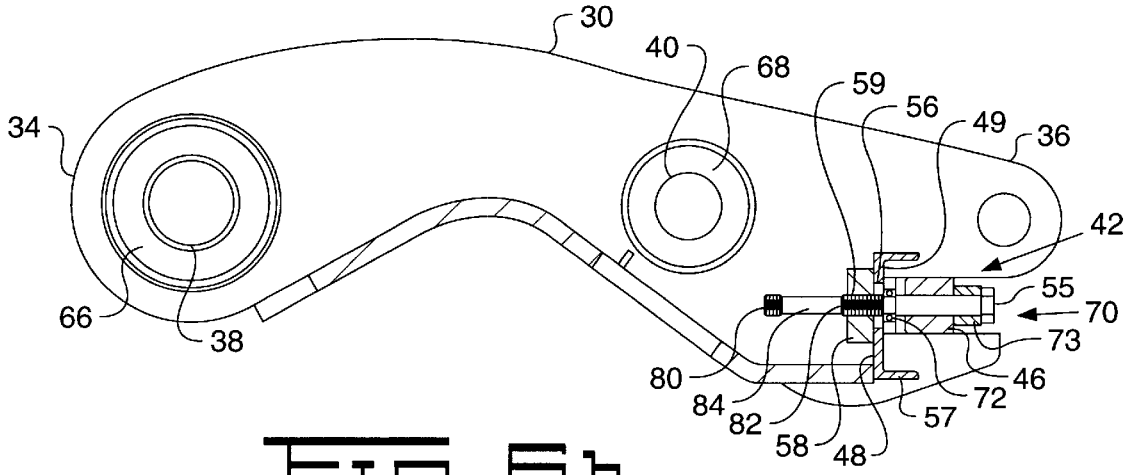
FIG. 6A depicts a cross-sectional view of the latching mechanism in a latched or closed position, in accordance with a preferred embodiment of the present invention.
Figure 6B:
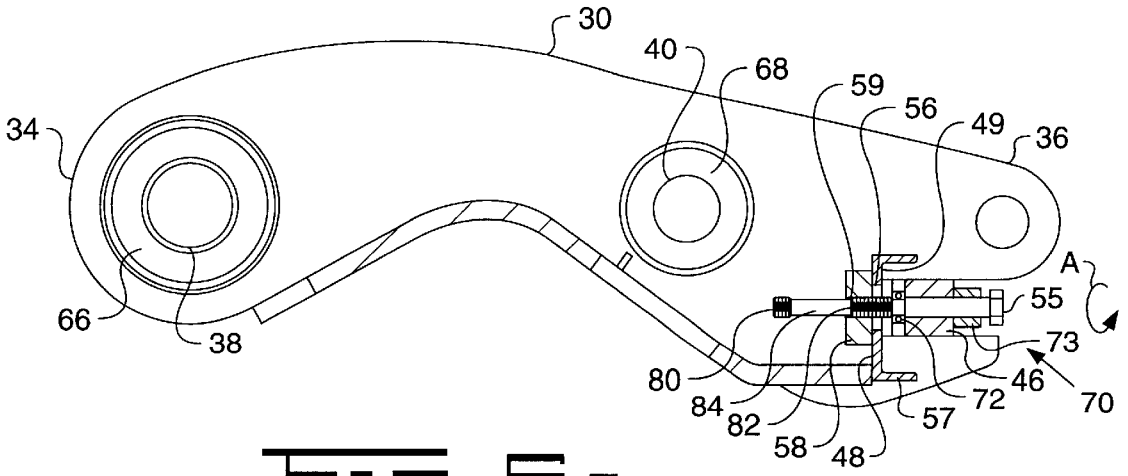
FIG. 6B depicts a cross-sectional view of the latching mechanism as the latching mechanism is being opened, in accordance with a preferred embodiment of the present invention.
Figure 6C:
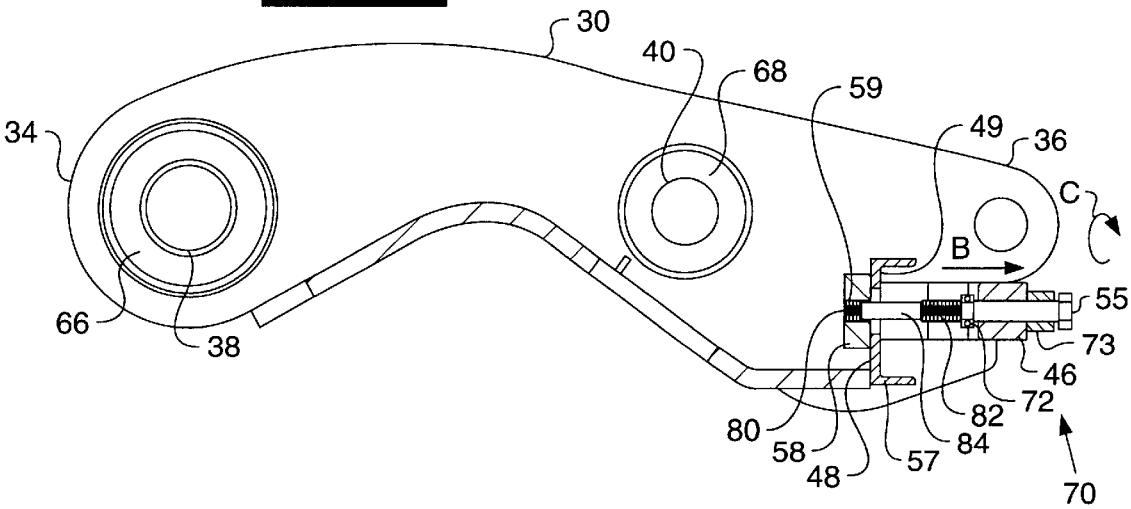
FIG. 6C depicts a cross-sectional view of the latching mechanism in an open position, in accordance with a preferred embodiment of the present invention.

FIGS. 6A–6C illustrate the motion of the latching mechanism 70 throughout various stages of the fastening or unfastening cycle. FIG. 6A shows the position of the latching mechanism 70 in a closed position. In other words, the coupler 10 is either free of any attachment, namely the bucket 12 in this example, or the attachment is secured to the coupler 10. In particular, the latching mechanism 70 is in the forwardmost position within the slot 42 of the plates 30. The retaining member 72, located around the necked region 86 of each jackscrew 54 (see FIG. 5), abuts a second surface 49 of the first mounting plate 57 thereby preventing further forward movement of the jackscrews 54 and latch bar 46.

To connect the bucket 12 to the coupler 10 the operator merely turns each jackscrew 54 in a counterclockwise direction, as illustrated by arrow A in FIG. 6B, until the second threaded region 82 of each jackscrew 54 becomes disengaged from the threaded openings 59 within the second mounting plate 58. Once the second threaded region 82 of each jackscrew 64 is disengaged from the second mounting plate 58, the operator may then pull each jackscrew 54 outward, in the direction indicated by arrow B in FIG. 6C, until the first threaded region 80 of each jackscrew 54 engages the threaded opening 59 of the second mounting plate 58, as depicted in FIG. 6C. As each jackscrew 54 is moved in the direction of arrow B, the latch bar 46 is also being urged away from the first mounting plate 57 and second mounting plate 58.

The first pair of trunnions 66 of the coupler 10 are manually placed within the hook openings 20 of the bracket 16 (FIG. 1). The coupler 10 is pivoted about the first pin 60 until the second pair of trunnions 68 engage the semi-circular cradle openings 28 of the bracket 16. The latch bar 46 is then maneuvered around the latching notches 22 of each bracket 16, such that the upper surface 50 of the latch bar 46 engages the inclined wedge surfaces 24 of the brackets 16. Each jackscrew 54 is then turned in a clockwise direction, indicated by arrow C in FIG. 6C, until the first threaded end 80 of each jackscrew 54 again passes through the threaded openings 59 of the second mounting plate 58. Each jackscrew 54 is then pushed forward, traversing the non-threaded regions 84, until the second threaded region 82 of each jackscrew 54 engages the threaded openings 59 of the second mounting plate 58, as again illustrated in FIG. 6B. The operator then continues to rotate each jackscrew 54 until the latch bar 46 is securely mounted within the notches 22 of the brackets 16, at which time the latching mechanism 70 is in a secured position, as depicted in FIG. 6A.

The coupler 10 may be detached from the brackets 16 of the bucket 12 by performing these steps in the opposite order described above. Thereafter, a different work tool (not shown) may be attached to the machine (not shown) via the quick coupler 10.

INDUSTRIAL APPLICABILITY

The latching mechanism 70 constructed in accordance with present invention is extremely effective in quickly and easily attaching and detaching the quick coupler 10 to the coupler receiving brackets 16 of bucket 12 or other work tool. In particular, because the jackscrew 54 contains only two relatively small threaded regions 80, 82, separated by a non-threaded region 84, the operator is able to quickly bias the jackscrew 54 in or out. Specifically, the non-threaded region 84 of the jackscrew 54 allows the operator to move the jackscrew 54 in either direction without wasting a great deal of time and energy turning a screw that has threads its entire length.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting.

Other aspects and features of the present invention can be obtained from a study of the drawings, the disclosure, and the appended claims.

What is claimed is:

1. An apparatus for coupling a tool to a machine, comprising:

a pair of plates, having a base mounted therebetween, pivotally connected to an extension of the machine;

an opening within a first end of the pair of plates;

a latching mechanism partially disposed within the opening of the plates for securely fastening the machine to a bracket of the tool, wherein the latching mechanism further includes at least one fastener having a first and a second threaded region, and a non-threaded region between the first and second threaded regions; and said latching mechanism further comprises: (i) a first mounting plate fixed between the pair of plates at the first end of the plates, having at least one opening through which the fastener traverses; and (ii) a second mounting plate affixed to the first mounting plate, having at least one threaded opening, aligned with the at least one opening in the first mounting plate, which engages the first and second threaded regions of the fastener.

2. The apparatus of claim 1, further including first and second lateral pins connected between the plates about which the plates pivot relative to the extension of the machine.

3. The apparatus of claim 2, further including a first and a second pair of trunnions axially aligned with the first and second pins, which engage first and second mounting surfaces of the bracket of the tool.

4. The apparatus of claim 1, wherein the latching mechanism comprises a wedge-shaped latch bar which interfaces a plurality of abutment surfaces within the opening of the plates and a mounting surface of the bracket of the tool.

5. The apparatus of claim 4, wherein a retaining member mounted around the fastener holds the latch bar at a first end of the fastener.

6. The apparatus of claim 1, wherein the machine comprises an earth working machine.

7. A latching mechanism of a coupling device for coupling a machine to a tool, comprising:

a mounting device affixed to a first end of a pair of plates of the coupling device;

a latch bar slidably mounted within an opening of the pair of plates;

at least one fastener secured within at least one opening of the latch bar, adapted to threadedly engage the mounting device, wherein the fastener includes at least two threaded regions separated by a non-threaded region; and the mounting device comprises: (i) a first mounting plate mounted between the plates having at least one opening therein; and (ii) a second mounting plate mounted to the first mounting plate having at least one threaded opening therein, wherein the threaded opening of the second mounting plate is aligned with the opening of the first mounting plate.

8. The latching mechanism of claim 7, wherein the latch bar is wedge-shaped.

9. The latching mechanism of claim 7, wherein the latch bar further includes a plurality of surfaces which contact a plurality of abutment surfaces of the tool.

10. The latching mechanism of claim 7, wherein the machine comprises an earth working machine.

11. An apparatus for coupling a tool to a machine, comprising:

a pair of plates, having a base mounted therebetween, pivotally connected to an extension of the machine;

an opening within a first end of the pair of plates;

a latching mechanism partially disposed within the opening of the plates for securely fastening the machine to a bracket of the tool, wherein the latching mechanism further includes at least one fastener having a first and a second threaded region, and a non-threaded region between the first and second threaded regions;

the latching mechanism comprises a wedge-shaped latch bar which interfaces a plurality of abutment surfaces within the opening of the plates and a mounting surface of the bracket of the tool; and wherein a retaining member mounted around the fastener holds the latch bar at a first end of the fastener.

12. The apparatus of claim 11, further including first and second lateral pins connected between the plates about which the plates pivot relative to the extension of the machine.

13. The apparatus of claim 12, further including a first and a second pair of trunnions axially aligned with the first and second pins, which engage first and second mounting surfaces of the retaining structure of the tool.

14. The apparatus of claim 11, wherein the machine comprises an earth working machine.

* * * * *